US009247787B2

(12) United States Patent
Dering et al.

(10) Patent No.: US 9,247,787 B2
(45) Date of Patent: Feb. 2, 2016

(54) CAMERA STRAP ATTACHMENT MECHANISM AND METHODS OF USE

(71) Applicant: Peak Design, LLC, San Francisco, CA (US)

(72) Inventors: Peter Dering, San Francisco, CA (US); Art Viger, San Francisco, CA (US); Mike Holmberg, San Francisco, CA (US)

(73) Assignee: Peak Design, LLC, San Francisco, CA (US)

( * ) Notice: Subject to any disclaimer, the term of this patent is extended or adjusted under 35 U.S.C. 154(b) by 30 days.

(21) Appl. No.: 14/062,890

(22) Filed: Oct. 25, 2013

(65) Prior Publication Data

US 2015/0113772 A1 Apr. 30, 2015

Related U.S. Application Data

(60) Provisional application No. 61/717,938, filed on Oct. 24, 2012.

(51) Int. Cl.

| | |
|---|---|
| ***A45B 21/00*** | (2006.01) |
| ***A45F 5/00*** | (2006.01) |
| ***A44B 11/25*** | (2006.01) |

(52) U.S. Cl.

CPC . *A44B 11/25* (2013.01); *A45F 5/00* (2013.01); *A44B 11/2584* (2013.01); *A45F 2005/006* (2013.01); *A45F 2005/008* (2013.01); *A45F 2200/0533* (2013.01); *Y10T 24/45225* (2015.01)

(58) Field of Classification Search

CPC ..... Y10T 24/1397; Y10T 24/4736; Y10T 24/4745; Y10T 24/314; Y10T 24/316; Y10T 24/3423; Y10T 24/36; G03B 17/566; A44B 11/02

USPC ..... 24/591.1, 3.13, 265 BC, 265 EC, 301, 24/323, 90.1; 224/930, 908, 197, 255, 271

See application file for complete search history.

(56) References Cited

U.S. PATENT DOCUMENTS

| | | | | |
|---|---|---|---|---|
| 1,550,904 | A * | 8/1925 | Jones et al. | 24/323 |
| 1,562,521 | A * | 11/1925 | Schlegel | 105/354 |
| 5,150,504 | A * | 9/1992 | Cohen | 24/302 |
| 5,699,591 | A * | 12/1997 | Kane | 24/304 |
| 5,784,760 | A * | 7/1998 | Leitzke et al. | 24/3.13 |
| 6,718,600 | B1 * | 4/2004 | Gillis | 24/459 |
| 6,966,519 | B2 * | 11/2005 | Salentine | A45F 5/004 224/162 |
| 7,000,291 | B2 * | 2/2006 | Fuller | 24/17 B |
| 7,354,304 | B2 * | 4/2008 | Livingston | A45F 5/00 439/501 |
| D608,541 | S * | 1/2010 | Myers | D3/215 |
| D682,488 | S * | 5/2013 | Kalbach | D30/152 |
| 2002/0170933 | A1 * | 11/2002 | Martin | A45F 5/02 224/197 |
| 2003/0019895 | A1 * | 1/2003 | Childers | A45F 5/02 224/251 |

(Continued)

*Primary Examiner* — Victor Batson
*Assistant Examiner* — Jason W San
(74) *Attorney, Agent, or Firm* — Adams Grumbles, LLP; Brittany Nanzig

(57) ABSTRACT

A male/female connection system is disclosed. The system is specifically designed as a novel way of attaching straps to cameras. The device includes a male attachment anchor with an overmolded loop, as well as a female housing inclusive of a spring to lock the male and the female together. The anchor connects to a camera at the neck strap loops using a cow hitch knot. The anchor connects to the housing by entering an open end, and being pulled through to an end where it is strapped. A strap connects to the housing by way of a loop being sewn around it.

15 Claims, 5 Drawing Sheets

(56) References Cited

U.S. PATENT DOCUMENTS

2008/0263838 A1* 10/2008 Shiue ..... 24/698.1
2009/0074399 A1* 3/2009 Su et al. ..... 396/423
2010/0035666 A1* 2/2010 Chang et al. ..... 455/575.1
2010/0054724 A1* 3/2010 Chamberlayne ..... 396/423
2011/0290970 A1* 12/2011 Fan ..... 248/274.1
2012/0311827 A1* 12/2012 Wilson ..... 24/304
2013/0312232 A1* 11/2013 Fujiwara ..... 24/572.1
2013/0340210 A1* 12/2013 Giordano ..... 24/265 EC
2014/0226962 A1* 8/2014 Henry ..... 396/423
2014/0231482 A1* 8/2014 Chamberlayne ..... 224/623
2014/0325795 A1* 11/2014 Lin ..... 24/3.13
2015/0016813 A1* 1/2015 Swaggart ..... 396/423

* cited by examiner

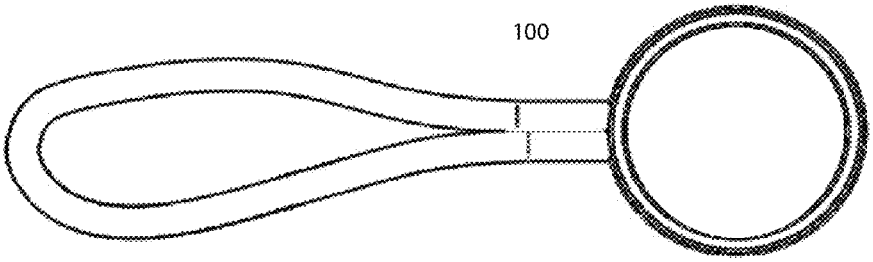
Figure 1
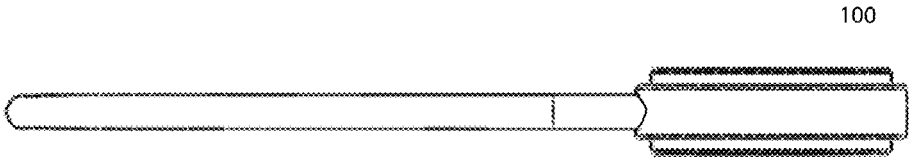
Figure 2
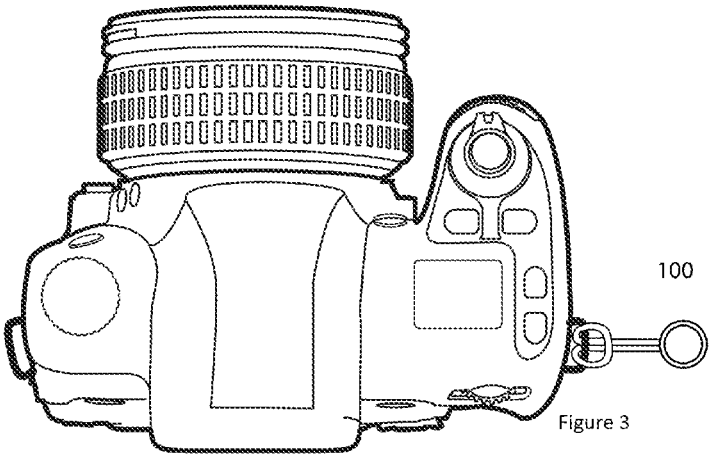
Figure 3
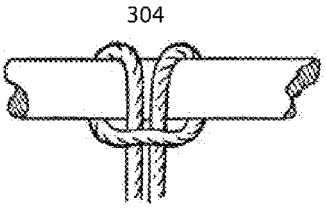

CAMERA STRAP ATTACHMENT MECHANISM AND METHODS OF USE

CROSS-REFERENCE TO RELATED APPLICATION

This application claims the benefit of U.S. Provisional Application No. 61/717,938 filed Oct. 24, 2012, titled CAMERA STRAP ATTACHMENT MECHANISM AND METHODS OF USE.

TECHNICAL FIELD

The present application relates to a device and methods for securely attaching to a camera a length of webbing to be used as a strap. More generally, the present application refers to a male/female connection system with female housing and male attachment anchor that can be used to connect many things together.

BACKGROUND

Camera straps are commonly attached to cameras using a system where webbing is doubled back on itself and run through a friction mechanism. This system is cumbersome and makes it difficult to attach or remove straps from cameras. Some types of photography are best done with a strap. Other types of photography are better accomplished without a strap. One method of providing a removable strap is to attach a short section of webbing using the friction mechanism, and then use a standard side release buckle. With this method, the main strap can be removed, and two sections of short webbing with a male buckle are left on the camera. The problem is that these short sections and male buckle are relatively bulky compared to the camera, cannot be removed easily, and the side release buckle can be accidentally released with too much tension. For these and other reasons, improvements are desirable.

SUMMARY

In general terms, the present disclosure relates to a male/female connection system using a female housing and a male attachment anchor that is capable of connecting many things together and overcomes the existing issues associated with removable straps. Although the invention is described in connection with cameras, the mechanism and methods disclosed herein can also be use with other objects other than cameras.

One aspect of the invention is a male/female connection system comprising an anchor having larger and smaller diameters, the anchor including a cord that is overmolded into a plastic disc that has larger and smaller diameters; a housing that is able to receive the anchor, the housing containing a spring which locks the anchor into a specific place within the housing; and a housing that is capable of being attached to a section of webbing, or other object.

BRIEF DESCRIPTION OF THE DRAWINGS

FIG. 1 is a top view of the male attachment anchor, according to one embodiment of the present disclosure;

FIG. 2 is a side elevation view of the male attachment anchor;

FIG. 3 is an isometric view of the male attachment anchor attached to a camera;

DETAILED DESCRIPTION

Figure 4:
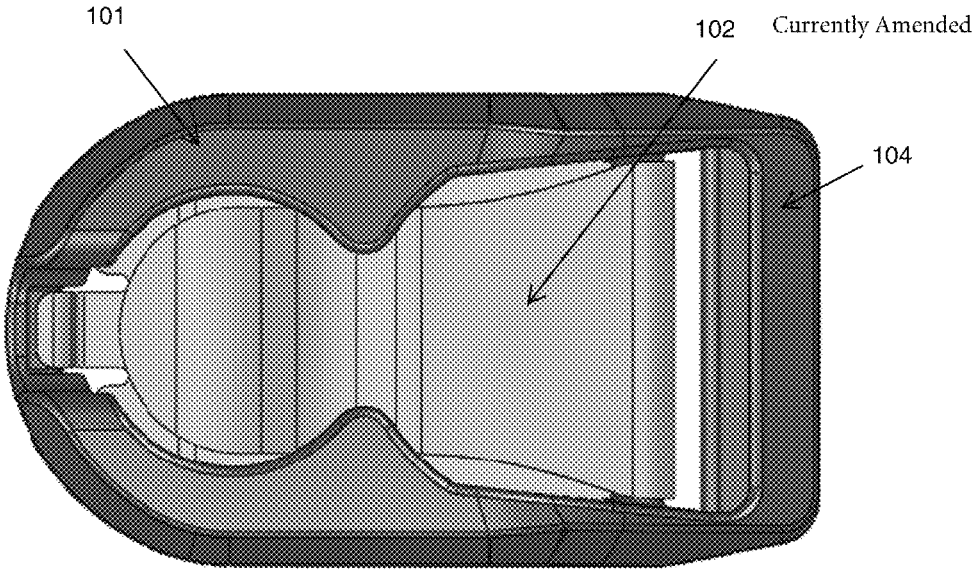
FIG. 4 is a top view of the female housing with spring, according to one embodiment of the present disclosure.

Various embodiments of the present invention will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Figure 9:
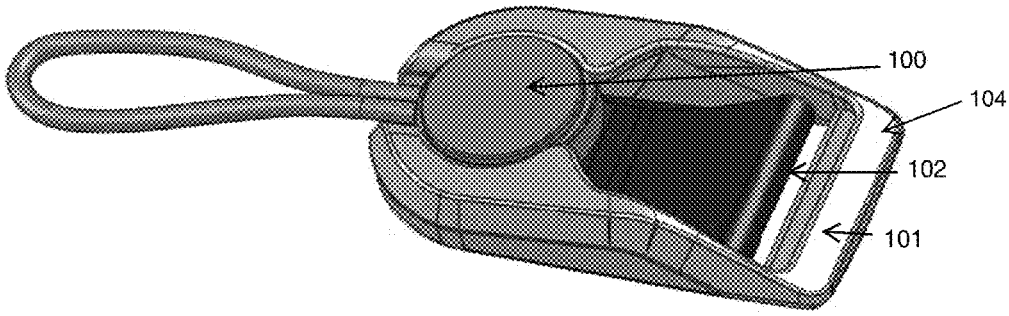
FIG. 9 is an isometric view of the male attachment anchor fully inserted into and locked with the female housing with spring.

In one embodiment, as illustrated in FIG. 1, a male attachment anchor 100 includes a section of high-strength synthetic cord, such as KEVLAR cord, that is overmolded (a process in which at least two materials are combined to produce a single object) by a plastic mechanism. The cord can be overmolded with a polymer and firmly held within the overmold. As shown in FIG. 1, the cord can form a loop, which can be of various lengths. The overmolded portion can also be various sizes. The overmolded shape is a symmetrical disk with a lip on top and bottom of smaller radius then the rest of the body. FIG. 2 is a side view of the anchor 100. This view shows the inner diameter and the outer diameter, which forms a lip. This lip can catch a corresponding shape on the female housing 102, as illustrated in FIG. 9.

The male attachment anchor 100 is intended to be connected to, and remain connected to, the camera strap loops 103 of a camera, as well as the loops 103 that exist on some tripod quick release plates. As illustrated in FIG. 3, the male attachment anchor 100 can be connected by means of a "cow hitch" or a "lanyard hitch" attachment 304. FIG. 3 illustrates one possible embodiment, wherein the anchor 100 can be attached to the camera. There are many possible embodiments of this attachment point: any closed loop or perpendicular cord, rope, or string is a possible attachment point. In FIG. 3, the anchor 100 is attached to a camera strap loop using a cow-hitch knot 304.

In one embodiment, the female housing 101 can consist of a plastic structure whereby one end of the structure is open to receive the male attachment anchor 100, and the other end is mostly enclosed to trap the male attachment anchor 100. The two ends can be connected by an open channel that the male attachment anchor 100 slides through. The bottom of the anchor 100 can include a spring 102, which can be initially unloaded.

Figure 7:
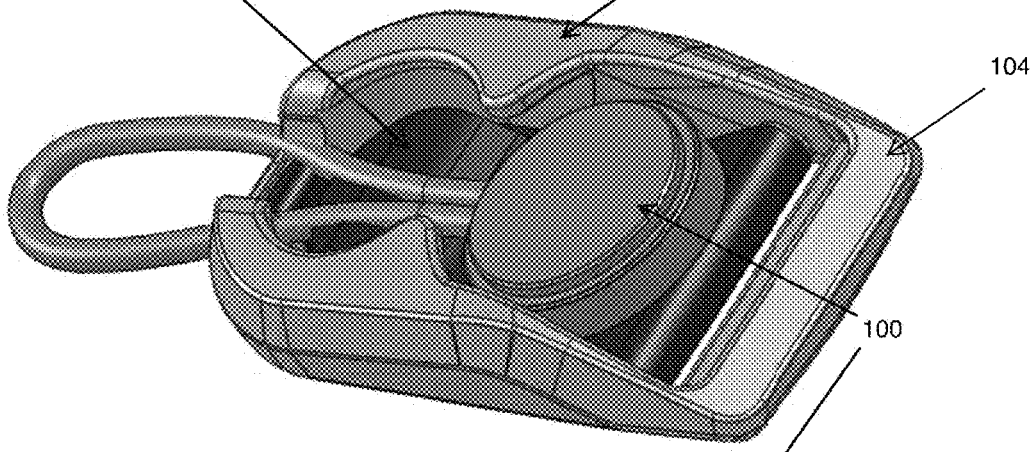
FIG. 7 is an isometric view of the male attachment anchor as it is first inserted into the female housing with spring.
Figure 8:
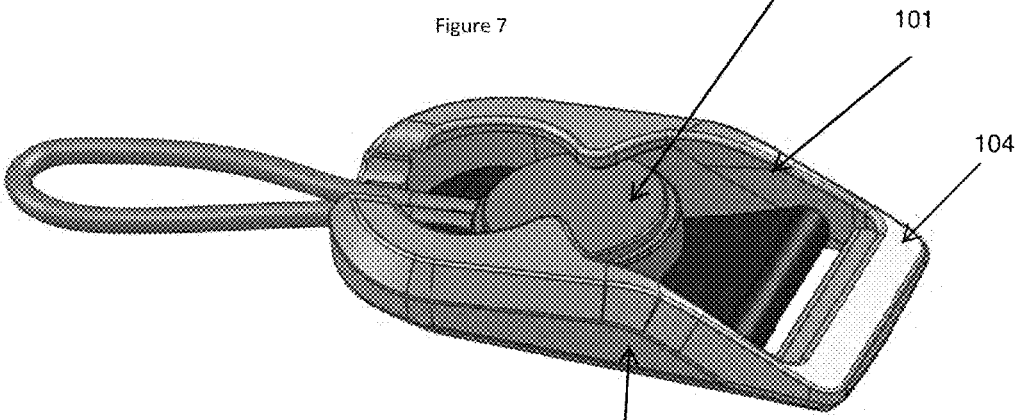
FIG. 8 is an isometric view of the male attachment anchor at the midpoint of being inserted into the female housing with spring.
Figure 10:
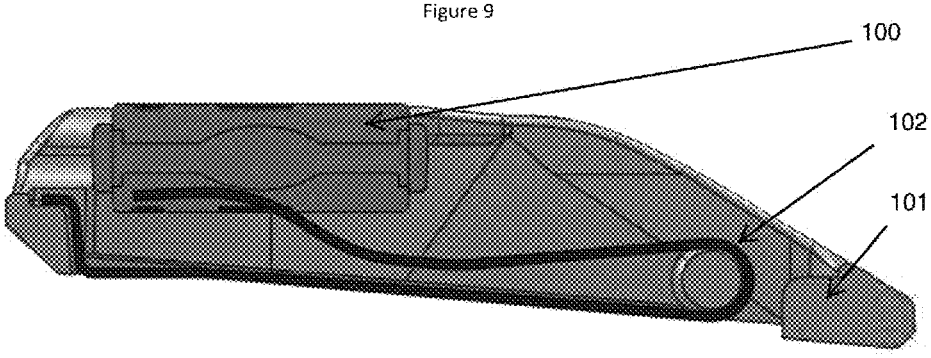
FIG. 10 is a section view of the male attachment anchor fully inserted into the female housing with spring.

As the male attachment anchor 100 moves from the open end of the female housing 101 toward the enclosed end, the spring 102 is deformed. FIGS. 7 through 10 illustrate the various positions the male attachment anchor 100 moves through from the open end of the female housing 101 toward the enclosed end. FIG. 7 illustrates the anchor 100 at the open entrance of the housing 101. FIG. 8 illustrates the anchor 100 as it is being pulled through the housing 101, wherein the spring 102 is partially depressed to make room for the anchor 100 within the housing 101. FIGS. 9 and 10 illustrate the anchor 100 at its final locked position within the housing 101.

When the male attachment anchor 100 reaches its final position in the enclosed end of the housing 101, it is moved up by the force of the spring 102 and into a receiving cavity in the housing 101. The lip of the male attachment anchor 100 interacts with a corresponding lip on the housing 101, which creates a lock. In this locked position, the spring 102 can be pressed against the bottom of the anchor 100, as illustrated in FIG. 10.

Figure 5:
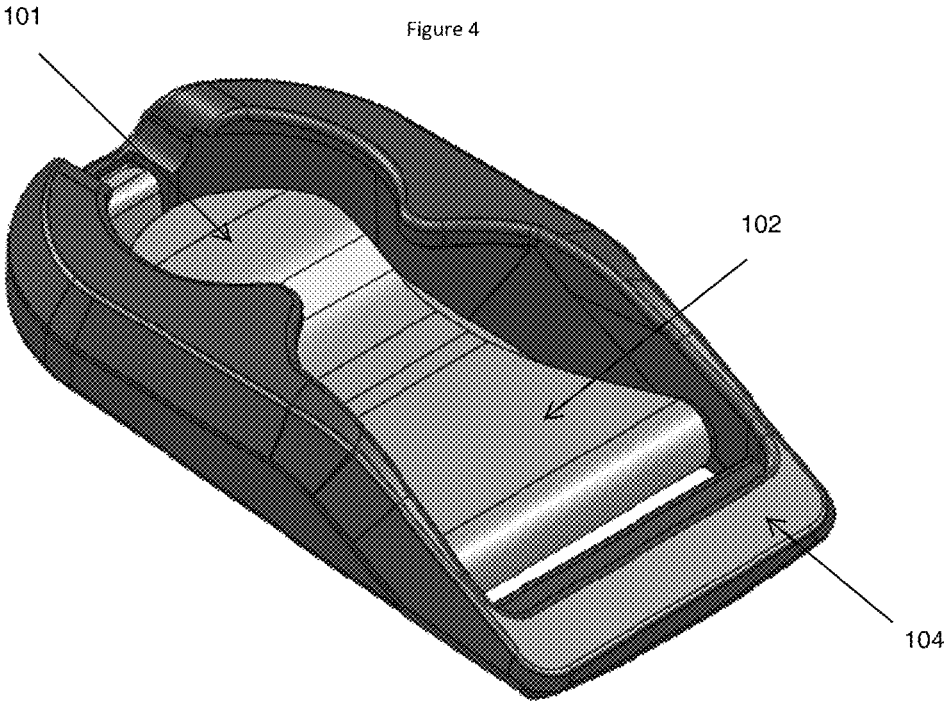
FIG. 5 is an isometric perspective view of the female housing with spring.
Figure 6:
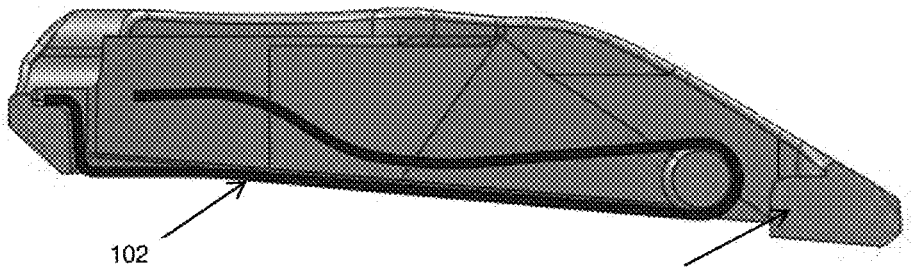
FIG. 6 is a section view of the female housing with spring.

In one embodiment, the spring 102 can serve as the back of the female housing 101, as illustrated in FIGS. 4 and 5. As illustrated in FIG. 6 (a side view of the female housing), the spring 102 in the back of the female housing 101 can wrap about an axle of circular cross section in the female housing 101.

In one embodiment, a method of releasing the male attachment anchor 100 from the female housing 101 is disclosed. When the mechanism is engaged, the male attachment anchor 100 has one face that is exposed to view, while all other parts of the anchor 100 remain entrapped. The male attachment anchor 100 is released when a user depresses this face against the force of the spring 102. After depressing the anchor 100 past the corresponding lip in the housing 101, the user can slide the male attachment anchor 100 out of the channel by moving it opposite the direction that it entered.

Figure 11:
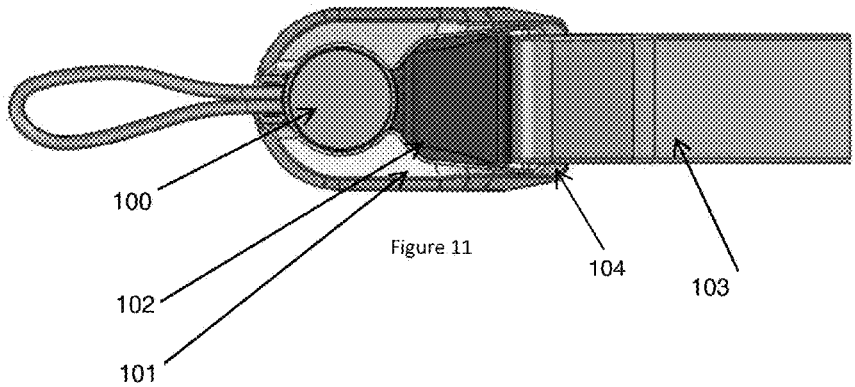
FIG. 11 is a top view of the male attachment anchor, fully inserted into, and locked with, the female housing with spring, with a strap attached to the bar of the female housing, according to one possible embodiment of the present disclosure.
Figure 12:
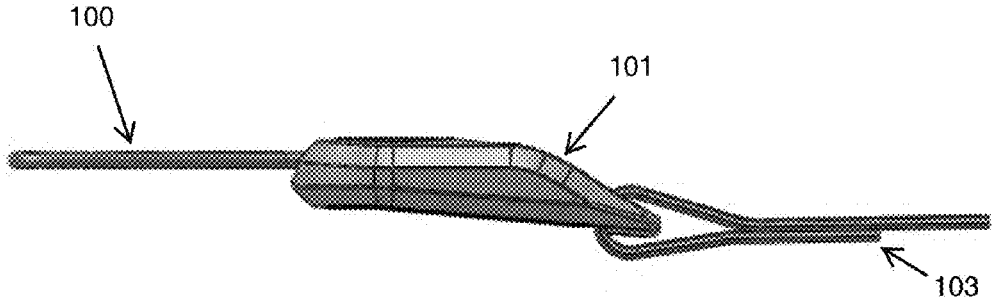
FIG. 12 is a side view of the male attachment anchor, fully inserted into, and locked with, the female housing with spring, with a strap attached to the bar of the female housing, according to one possible embodiment of the present disclosure.
Figure 13:
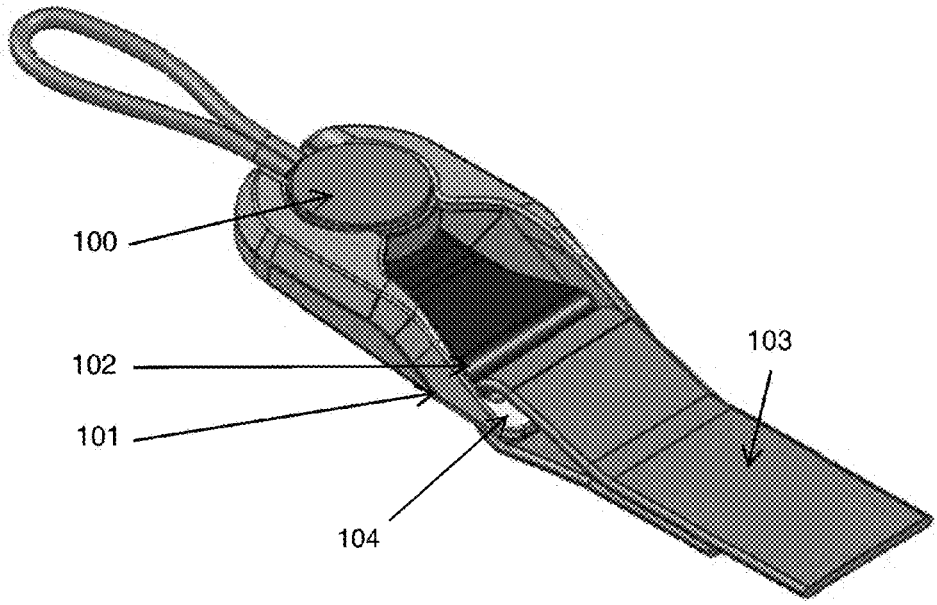
FIG. 13 is an isometric view of the male attachment anchor, fully inserted into, and locked with, the female housing with spring, with a strap attached to the bar of the female housing, according to one possible embodiment of the present disclosure.

In one embodiment, one portion of the female housing 101 can be attached to a strap 103 or other material, as illustrated in FIGS. 11 through 13. The portion of the housing 101 attached to the strap 103 can consist of a bar 104 made of plastic or another rigid material. Additionally, a piece of webbing can be sewn around the bar 104, or looped around the bar 104, and attached in a different fashion.

The invention claimed is:

1. A male/female system for secure attachment to a camera comprising:

an anchor comprising a solid disk affixed to a flexible cord; and a housing for the anchor comprising:

an open, back end;

an at least partially enclosed end having a top surface and at least a portion corresponding to the shape of the solid disk;

an open channel connecting the open, back end to the at least partially enclosed end; and a base having a spring, the spring having a first end near the open, back end and a compressible second end near the at least partially enclosed end;

wherein:

the at least partially enclosed end and the base contain the solid disk;

the disk is comprised of a top lip and a body;

a diameter of the body is larger than a diameter of the top lip;

the top surface of the at least partially enclosed end comprises a lip ledge, the lip ledge of the at least partially enclosed end having a diameter that is smaller than the diameter of the body of the disk and larger than the diameter of the top lip of the disk;

the spring releasably locks the solid disk inside the housing by pushing the top lip of the disk away from the base and toward the lip ledge of the at least partially enclosed end; and wherein the top lip of the solid disk is fitted correspondingly to the lip ledge.

2. The male/female system of claim 1, wherein the solid disk is further comprised of a bottom lip.

3. The male/female system of claim 2, wherein the diameter of the body is larger than a diameter of the bottom lip.

4. The male/female system of claim 3, wherein the top lip and the bottom lip are symmetrical.

5. The male/female system of claim 1, further comprising a bar located near the first end of the spring.

6. The male/female system of claim 5, further comprising an adjustable strap attached to the bar.

7. The male/female system of claim 1, wherein the solid disk is plastic.

8. The male/female system of claim 1, wherein the cord is in the form of a loop.

9. The male/female system of claim 1, further comprising two parallel, solid sides.

10. The male/female system of claim 1, wherein the solid disk is rigid.

11. The male/female system of claim 1, wherein the solid disk is permanently affixed to the flexible cord.

12. The male/female system of claim 1, wherein the housing is plastic.

13. A male/female system for secure attachment to a camera comprising:

an anchor comprising a rigid, solid disk affixed to a flexible cord;

wherein the rigid, solid disk is comprised of a top lip, a body, and a bottom lip;

wherein a diameter of the body is larger than a diameter of the top lip and a diameter of the bottom lip; and wherein the top lip and the bottom lip are symmetrical; and a housing for the anchor comprising:

an open, back end;

a mostly enclosed end having a top surface comprising a lip ledge corresponding to the top lip of the rigid, solid disk;

an open channel connecting the open, back end to the mostly enclosed end;

a base having a spring, the spring having a first end near the open, back end and a compressible second end near the mostly enclosed end;

wherein the mostly enclosed end and the base contain the rigid, solid disk;

wherein the spring releasably locks the rigid, solid disk inside the housing by pushing the disk away from the base and toward the lip ledge of the mostly enclosed end; and wherein the top lip of the rigid, solid disk is fitted correspondingly to the lip ledge.

14. The male/female system of claim 13, further comprising a bar located near the first end of the spring and an adjustable strap attached to the bar.

15. A male/female system for secure attachment to a camera comprising:

an anchor comprising a rigid, solid, plastic disk permanently affixed to a flexible cord that is in the form of a loop;

wherein the rigid, solid, plastic disk is comprised of a top lip, a body, and a bottom lip; wherein a diameter of the body is larger than a diameter of the top lip and a diameter of the bottom lip; and wherein the top lip and the bottom lip are symmetrical; and a plastic housing for the anchor comprising:

an open, back end;

a mostly enclosed end having a lip ledge corresponding to the top lip of the rigid, solid, plastic disk;

an open channel connecting the open, back end to the mostly enclosed end;

a base having a spring and a bar, the spring having a first end near the open, back end and a compressible, second end near the mostly enclosed end, and the bar being located near the first end of the spring;

a strap attached to the bar; and two parallel, solid sides;

wherein the mostly enclosed end, the base, and the two parallel, solid sides contain the rigid, solid, plastic disk;

wherein the spring releasably locks the rigid, solid, plastic disk inside the housing; and wherein the top lip of the rigid, solid disk is fitted correspondingly to the lip ledge.

* * * * *

UNITED STATES PATENT AND TRADEMARK OFFICE

CERTIFICATE OF CORRECTION

PATENT NO. : 9,247,787 B2
APPLICATION NO. : 14/062890
DATED : February 2, 2016
INVENTOR(S) : Peter Dering It is certified that error appears in the above-identified patent and that said Letters Patent is hereby corrected as shown below:

In the specification:

Column 1, line 9 should read as follows:
--...can also be used with other...--

Column 1, line 54 should read as follows:
--...spring, which locks the anchor...--

Column 2, lines 54-55 should read as follows:
--...female housing 101, as illustrated in FIG. 9.--

Column 3, lines 6-7 should read as follows:
--...bottom of the female housing 101 can include...--

Signed and Sealed this
Tenth Day of May, 2016

Michelle K. Lee

Michelle K. Lee
*Director of the United States Patent and Trademark Office*